US007976120B2

(12) United States Patent
Oh

(10) Patent No.: US 7,976,120 B2
(45) Date of Patent: Jul. 12, 2011

(54) IMAGE FORMING APPARATUS

(75) Inventor: Jeong-seok Oh, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 438 days.

(21) Appl. No.: 11/872,840

(22) Filed: Oct. 16, 2007

(65) Prior Publication Data

US 2008/0316250 A1 Dec. 25, 2008

(30) Foreign Application Priority Data

Jun. 20, 2007 (KR) ..... 10-2007-0060771

(51) Int. Cl.
*B41J 2/165* (2006.01)

(52) U.S. Cl. ..... 347/28

(58) Field of Classification Search ..... 347/28
See application file for complete search history.

(56) References Cited

U.S. PATENT DOCUMENTS

| | | | | |
|---|---|---|---|---|
| 5,412,411 | A * | 5/1995 | Anderson | 347/28 |
| 6,079,808 | A * | 6/2000 | Yamaguchi | 347/30 |
| 6,517,189 | B2 * | 2/2003 | Ogawa et al. | 347/35 |
| 6,802,588 | B2 * | 10/2004 | Garbacz et al. | 347/28 |
| 2002/0175969 | A1 * | 11/2002 | Suzuki | 347/28 |

* cited by examiner

*Primary Examiner* — Omar Rojas
(74) *Attorney, Agent, or Firm* — Stanzione & Kim, LLP

(57) ABSTRACT

An image forming apparatus including a printing ink tank to contain a printing ink, a nozzle unit having a nozzle part to eject the printing ink and to move between a printing section and a cleaning section, a cleaning ink tank to contain a cleaning ink to clean the nozzle part, and a control part to control supply of the printing ink to the nozzle part when the nozzle unit is positioned in the printing section and to control supply of the cleaning ink to the nozzle part when the nozzle unit is positioned in the cleaning section. The Image forming apparatus may further include a cleaning ink collecting unit which collects the cleaning ink discharged from the nozzle part and returns the collected cleaning ink to the cleaning ink tank.

22 Claims, 3 Drawing Sheets

IMAGE FORMING APPARATUS

CROSS-REFERENCE TO RELATED APPLICATIONS

This application claims priority under 35 U.S.C. §119(a) from Korean Patent Application No. 10-2007-0060771, filed on Jun. 20, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus having an improved structure to clean a nozzle part.

2. Description of the Related Art

In general, an ink jet image forming apparatus includes a nozzle part, which is installed at a lower part thereof, and a cartridge in which ink is contained. The ink in the cartridge is ejected onto a printing medium as a droplet.

In such an image forming apparatus, foreign substances, like ink remnants, may be collected in the nozzle part and may clog the nozzle part. Thus, ink ejection may be obstructed or ink may be improperly ejected onto the printing medium, thereby deteriorating image quality.

To solve the above problem, according to a conventional image forming apparatus, part of a printing ink in a cartridge is ejected through a nozzle part at a high pressure to clean the nozzle part.

However, in the conventional image forming apparatus, a printing ink loss is generated due to the cleaning process.

Further, the printing ink which has passed through the cleaning process cannot be reused for image forming because it has been already affected by heat, etc., and should be wasted by an additional device.

SUMMARY OF THE INVENTION

The present general inventive concept provides an image forming apparatus which is capable of cleaning a nozzle part without using a printing ink.

The present general inventive concept also provides an image forming apparatus to collect ink which has passed through a cleaning process and to reuse the ink for another cleaning process.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus comprising a printing ink tank to contain a printing ink, a nozzle unit having a nozzle part to eject the printing ink and to move between a printing section and a cleaning section, a cleaning ink tank to contain a cleaning ink to clean the nozzle part, and a control part to control supply of the printing ink to the nozzle part when the nozzle unit is positioned in the printing section and to control supply of the cleaning ink to the nozzle part when the nozzle unit is positioned in the cleaning section.

The printing section may be a printing position in which the nozzle unit forms an image on a printing medium and the cleaning section may be a cleaning position in which the nozzle unit moves out of the printing position and the nozzle part is cleaned. Alternatively, the printing section may be a printing time when the nozzle unit forms an image on a printing medium and the cleaning section may be a cleaning time when the nozzle part is cleaned.

The printing ink tank may be installed on the nozzle unit to supply the printing ink to the nozzle part.

The image forming apparatus may further comprise a main supply path formed in the nozzle unit to connect the printing ink tank and the nozzle part.

The image forming apparatus may further comprise an auxiliary supply path that extends from the main supply path to connect to the cleaning ink supply outlet when the nozzle unit is positioned in the cleaning section.

The image forming apparatus may further comprise a switch valve provided at a point where the main auxiliary supply path connects to the main supply path to selectively block supply of the printing ink and to selectively allow supply of the cleaning ink according to the position of the nozzle unit.

The image forming apparatus may further comprise a cleaning ink collecting unit which collects the cleaning ink discharged from the nozzle part and returns the collected cleaning ink to the cleaning ink tank.

The cleaning ink collecting part may comprise a collecting cup which collects the cleaning ink discharged from the nozzle part, and a collecting path which returns the cleaning ink collected in the collecting cup to the cleaning ink tank.

The switch valve may block supply of the printing ink and may allow supply of the cleaning ink when the nozzle unit is in the cleaning section, and the switch valve may allow supply of the printing ink when the nozzle unit is in the printing section.

The foregoing and/or other aspects and utilities of the present general inventive concept are also achieved by providing an image forming apparatus, comprising a nozzle unit to form an image on a printing medium, a printing ink unit to store a printing ink and to supply the printing ink to the nozzle unit, a cleaning unit to store a cleaning ink and to supply the cleaning ink to the nozzle unit, and an ink selection unit, to selectively supply one of the printing ink and the cleaning ink to the nozzle unit.

The nozzle unit may be positionable at one of a printing position to form the image on the printing medium and a cleaning position to clean the nozzle unit, and the ink selection unit may supply the printing ink to the nozzle unit when the nozzle unit is at the printing position and may supply the cleaning ink to the nozzle unit when the nozzle unit is in the cleaning position.

The image forming apparatus may further comprise a nozzle unit supporter to support the nozzle unit and to allow the nozzle unit to move between the printing position and the cleaning position.

The cleaning unit may comprise a cleaning ink supply path to supply the cleaning ink to the nozzle unit, and the supply path may connect to the nozzle unit when the nozzle unit is at the cleaning position and the supply path may not be connected to the nozzle unit when the nozzle unit is at the printing position.

The cleaning ink may not be supplied to the nozzle unit during a printing operation.

The printing ink may not be supplied to the nozzle unit during a cleaning operation.

The foregoing and/or other aspects and utilities of the present general inventive concept are also achieved by providing an image forming apparatus, comprising a movable nozzle unit to move between a printing position to form an image on a printing medium and a cleaning position to clean the nozzle unit, a printing ink tank to supply a printing ink to the nozzle unit when the nozzle unit is at the printing position, a cleaning ink tank to supply a cleaning ink to the nozzle unit when the nozzle unit is at the cleaning position, and a controller to control supply of the printing ink and the cleaning ink to the nozzle unit according to a position of the nozzle unit.

The controller may prevent the printing ink from being supplied to the nozzle unit during a cleaning operation, and may prevent the cleaning ink from being supplied to the nozzle unit during a printing operation.

The foregoing and/or other aspects and utilities of the present general inventive concept are also achieved by providing a method of cleaning a nozzle unit of an image forming apparatus, the method comprising positioning the nozzle unit at a cleaning position, supplying a cleaning ink to the nozzle unit, and ejecting the cleaning ink through the nozzle unit to clean the nozzle unit, wherein the cleaning ink is supplied separately from a printing ink used to form an image on a printing medium.

The cleaning ink may not be supplied to form an image on the printing medium.

The supplying of the cleaning ink to the nozzle unit may comprise connecting a cleaning ink supply path to the nozzle unit, supplying the cleaning ink to the nozzle unit, and preventing the printing ink from being supplied to the nozzle unit.

The cleaning position may be a position different from a printing position at which the nozzle unit performs a printing operation to form an image on the printing medium.

The method may further comprise returning the nozzle unit to a printing position.

The returning of the nozzle unit to the printing position may comprise positioning the nozzle unit at the printing position, supplying the printing ink to the nozzle unit, and preventing the cleaning ink from being supplied to the nozzle unit.

The returning of the nozzle unit to the printing position may further comprise disconnecting the cleaning ink supply path from the nozzle unit.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
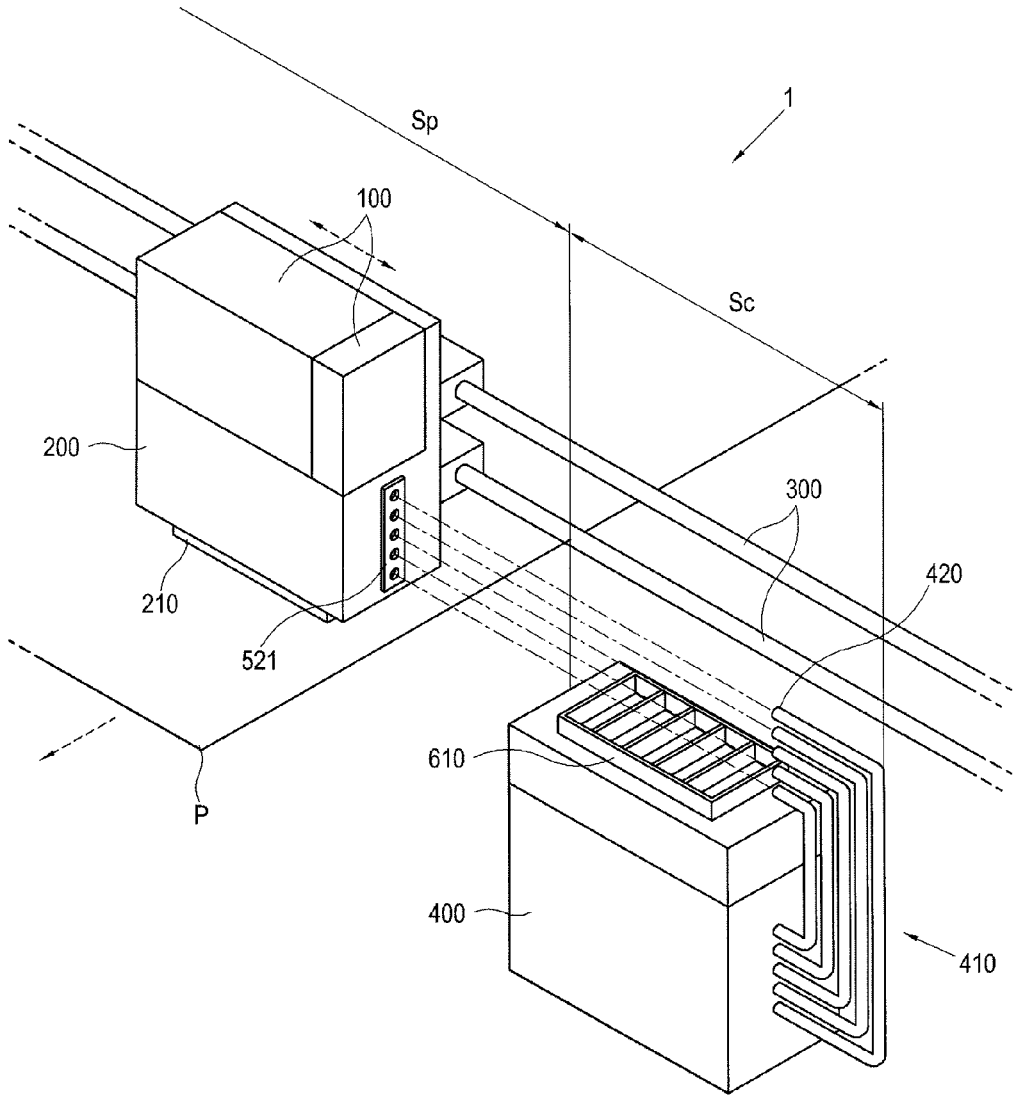
FIG. 1 illustrates a main part of an image forming apparatus according to an exemplary embodiment of the present general inventive concept when a nozzle unit is positioned in a printing section.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Figure 2:
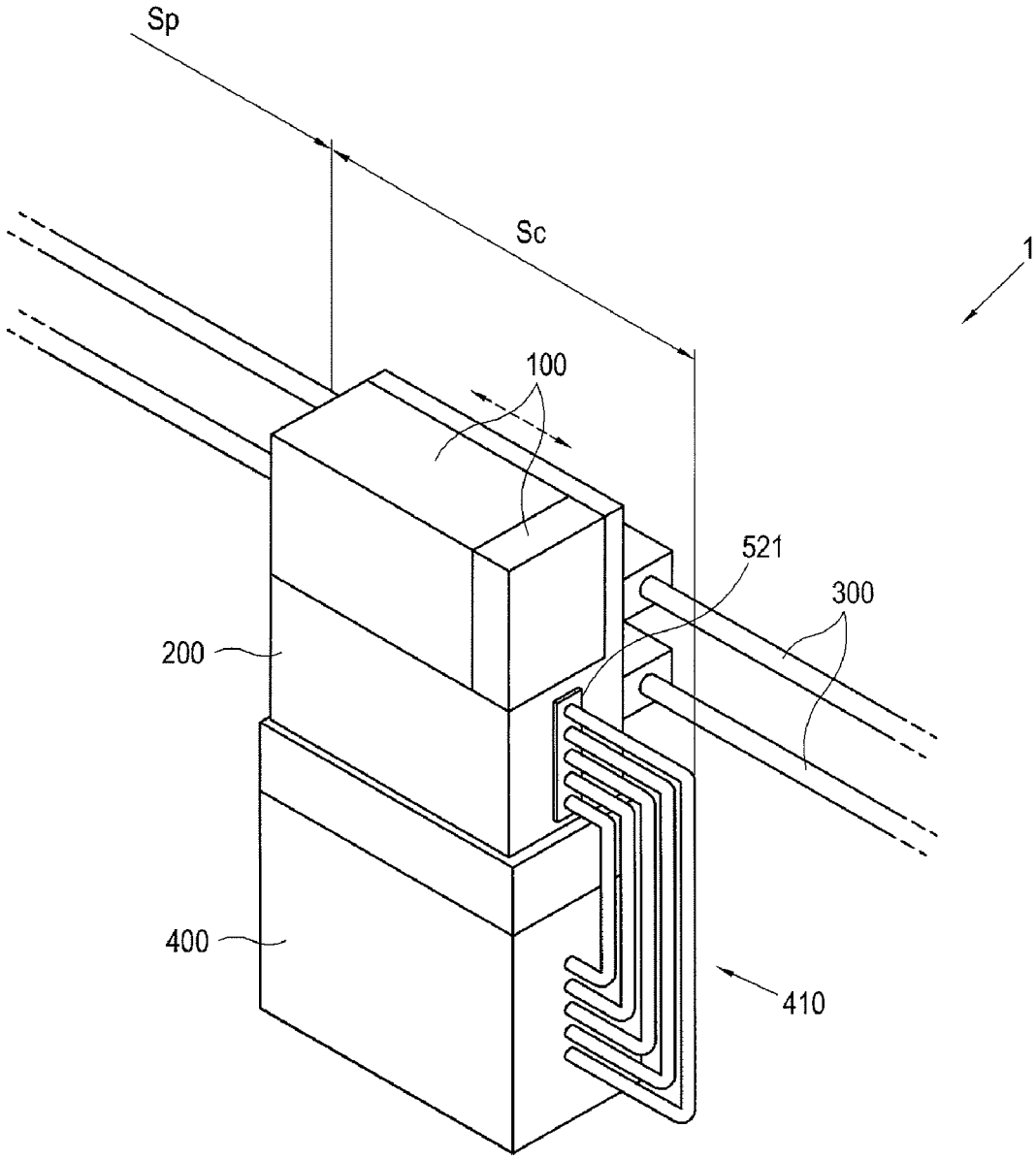
FIG. 2 illustrates the main part of the image forming apparatus illustrated in FIG. 1 when the nozzle unit is positioned in a cleaning section.
Figure 3:
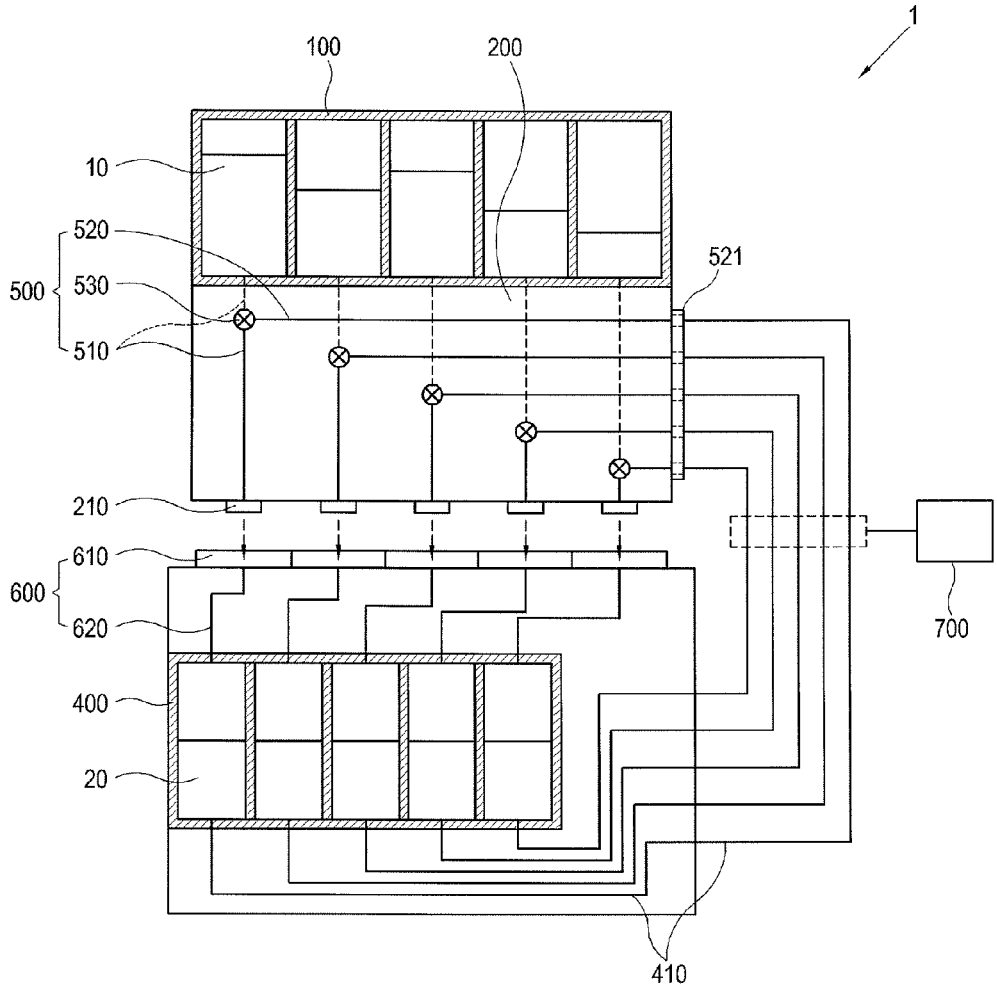
FIG. 3 is a schematic section view illustrating the image forming apparatus illustrated in FIG. 2.

Referring to FIGS. 1 to 3, an image forming apparatus 1 according to an exemplary embodiment of the present general inventive concept can form an image on a printing medium P by ejecting ink. The image forming apparatus 1 may include a printing ink tank 100 in which a printing ink 10 is contained, and a nozzle unit 200 comprising a nozzle part 210 through which the printing ink 10 is ejected.

The nozzle unit 200 can be supported by a nozzle unit support 300 so as to move between a printing section Sp and a cleaning section Sc.

The image forming apparatus may further include a cleaning ink tank 400 in which a cleaning ink 20 is contained, an ink supply unit 500 which selects and supplies one of the printing ink 10 and the cleaning ink 20 to the nozzle part 210 as the position of the nozzle unit 200 varies, a cleaning ink collecting unit 600 which collects the cleaning ink 20 discharged from the nozzle part 210 and returns it to the cleaning ink tank 400, and a pump 700 which forms a pressure to supply and return the cleaning ink 20.

The printing ink 10 is used to form an image on the printing medium P, whereas the cleaning ink 20 is used to clean the nozzle part 210 to prevent the nozzle part from being clogged by foreign substances, such as ink remnants.

The printing ink 10 can have various colors, for example, the printing ink 10 can comprise inks of four colors including cyan, magenta, yellow, and black to form a color image, and the cleaning ink 20 can also have various colors to correspond to the printing ink 10. Accordingly, even if the printing ink 10 and the cleaning ink 20 are mixed with each other during the cleaning process, image quality deterioration on the printing medium P can be prevented.

The printing ink tank 100 which contains therein the printing ink 10 may be installed on the nozzle unit 200 to supply the printing ink 10 to the nozzle part 210 and then ejected therethrough.

The printing ink tank 100 can be plurally partitioned to individually contain therein the various colors of printing inks 10. If the printing ink 10 in the printing ink tank 100 is exhausted, the printing ink tank 100 may be separated from the nozzle unit 200 and replaced with a new one.

The nozzle unit 200 can be, as described above, supported by the nozzle unit support 300 and can move between the printing section Sp and the cleaning section Sc. When the nozzle unit is positioned in the printing section Sp, the nozzle unit 200 can perform a printing operation onto the printing medium P, and when the nozzle unit 200 moves out of the printing section Sp into the cleaning section Sc, the cleaning process can be performed for the nozzle part 210.

Here, the printing section Sp and the cleaning section Sc may represent different positions where the printing and cleaning processes are performed, respectively, but alternatively, may represent times at which the printing and cleaning processes are performed, respectively.

The nozzle unit 200 on which the printing ink tank 100 can be installed may include the nozzle part 210 at a lower part thereof, to which the printing ink 10 is supplied from the printing ink tank 100. When the nozzle unit 200 is positioned in the printing section Sp, the printing ink 10 is ejected through the nozzle part 210 to form an image on the printing medium P.

The nozzle unit support 300 supports the nozzle unit 200 so that the nozzle unit 200 can move between the printing section Sp and the cleaning section Sc. For example, as illustrated in FIG. 1, the nozzle unit support 300 may be provided as a guide rail support or other means known in the art. With this configuration, the nozzle unit 200 can move above the printing medium P in the printing section Sp, and can move from above the printing medium P in the cleaning section Sc.

The cleaning ink tank 400 can be positioned adjacent to the nozzle unit 200 when the nozzle unit 200 is positioned in the cleaning section Sc. The cleaning ink tank 400 can be plurally partitioned so as to individually contain therein the various colors of cleaning printing inks 20, similar to the printing ink tank 100.

A cleaning ink supply path 410 can extend from the cleaning ink tank 400 to supply the cleaning ink 20 to an outside of the cleaning ink tank 400. The cleaning ink supply path 410 may be plurally provided corresponding to the various colors of cleaning inks 20. An outlet end part of the cleaning ink supply path 410 may be called a cleaning ink supply outlet 420.

The cleaning ink supply outlet 420 is connected to a path connector 521 (to be described later) when the nozzle unit 200 is positioned in the cleaning section Sc, thereby allowing the cleaning ink 20 to be supplied from the cleaning ink tank 400 to the nozzle unit 210. Further, the cleaning ink supply outlet 420 is separated from the path connector 521 when the nozzle unit 200 moves from the cleaning section Sc to the printing section Sp.

The ink supply unit 500 supplies the printing ink 10 to the nozzle part 210 when the nozzle unit 200 is positioned in the printing section Sp, and supplies the cleaning ink 20 to the nozzle part 210 when the nozzle unit 200 is positioned in the cleaning section Sc.

The ink supply unit 500 may include a main supply path 510 which connects the printing ink tank 100 to the nozzle part 210, an auxiliary supply path 520 which connects the main supply path 510 to the cleaning ink supply outlet 420 when the nozzle unit 200 is positioned in the cleaning section Sc, and a switch valve 530 which is installed at a point where the main and auxiliary supply paths 510 and 520 are connected to each other to selectively allow supply of the printing ink 10 and the cleaning ink 20 to the nozzle part 210.

The main supply path 510 is installed inside the nozzle unit 200 and transfers therethrough the printing ink 10 in the printing ink tank 100 to the nozzle part 210. The main supply path 510 may be plurally provided corresponding to the various colors of printing inks 10 and cleaning inks 20. Similarly, the auxiliary supply path 520 and the switch valve 530 may also be plurally provided.

The auxiliary supply path 520 extends from the switch valve 530 toward the outside of the nozzle unit 200 and forms the path connector 521 to which the cleaning ink supply outlet 420 is connected. Thus, the cleaning ink 20 can be supplied to the auxiliary supply path 520 from the cleaning ink tank 400 through the cleaning ink supply path 410 and the cleaning ink supply outlet 420.

The path connector 521 may be designed to easily separate from the cleaning ink supply outlet 420 when the nozzle unit 200 moves from the cleaning section Sc to the printing section Sp. On the other hand, when the path connector 521 is connected to both the auxiliary supply path 520 and the cleaning ink supply outlet 420, the path connector 521 and the cleaning ink supply outlet may form an airtight seal.

The switch valve 530 can be, as described above, installed at the point where the main supply path 510 and the auxiliary supply path 520 are connected to each other, and selectively opens and closes an upstream of the main supply path 510 and the auxiliary supply path 520. Here, the upstream of the main supply path 510 connects between the printing ink tank 100 and the switch valve 530, and a downstream thereof connects between the switch valve 530 and the nozzle part 210.

The switch valve 530 closes the upstream of the main supply path 510 and opens the auxiliary supply path 520 when the cleaning ink supply outlet 420 is connected to the auxiliary supply path 520. Accordingly, the printing ink 10 is blocked from being supplied from the printing ink tank 100 to the downstream of the main supply path 510, and the cleaning ink 20 can be supplied from the cleaning ink tank 400 to the downstream of the main supply path 510 and the nozzle part 210. At this time, the cleaning ink 20 does not flow through the upstream of the main supply path 510 into the printing ink tank 100 because the upstream of the main supply path 510 is closed by the switch valve 530.

On the other hand, when the cleaning ink supply outlet 420 is separated from the auxiliary supply path 520, the switch valve 530 opens the upstream of the main supply path 510 and closes the auxiliary supply path 520. Accordingly, the printing ink 10 can be supplied from the printing ink tank 100 to the nozzle part 210 through the downstream of the main supply path 510, and the cleaning ink 20 is blocked from being supplied to the nozzle part 210.

To operate the switch valve 530 as described above, various technologies may be used herein. For example, the switch valve 530 may be controlled by a controller (not illustrated) of the image forming apparatus 1, in which the controller senses whether the cleaning ink 20 is supplied to the auxiliary supply path 520. Alternatively, the switch valve 530 may be opened and closed while interlocking with the connection and the separation between the cleaning ink supply outlet 420 and the auxiliary supply path 520.

The cleaning ink collecting unit 600 can be installed under the nozzle part 210 when the nozzle unit 200 is positioned in the cleaning section Sc, and can collect the cleaning ink 20 which has been ejected through the nozzle part 210 and used for the cleaning process and can return it to the cleaning ink tank 400. Thus, the used cleaning ink 20 may be reused for a next cleaning process.

The cleaning ink collecting unit 600 may include a collecting cup 610 installed so as to face the nozzle part 210 when the nozzle unit 200 is positioned in the cleaning section Sc, and a returning path 620 which connects the collecting cup 610 to the cleaning ink tank 400.

The collecting cup 610 may be plurally partitioned or plurally provided so as to correspond to the various colors of cleaning inks 20. The collecting cup 610 can be arranged adjacent to the nozzle part 210 to prevent the cleaning ink 20 discharged from the nozzle part 210 from affecting other elements of the image forming apparatus 1. The collecting cup 610 may be made of rubber or the like to prevent the cleaning ink 20 from spattering by collision against the collecting cup 610.

The returning path 620 returns the cleaning ink collected in the collecting cup 610 to the cleaning ink tank 400.

The pump 700 may be provided as a pneumatic pump and can provide a pneumatic pressure to circulate the cleaning ink 20 between the cleaning ink tank 400 and the nozzle part 210. The pump 700 may be controlled by the controller of the image forming apparatus 1. The pump 700 may further include a pressure controller (not illustrated) to control the pneumatic pressure inside the returning path 620.

Hereinafter, the cleaning process for the nozzle part 210 according to an exemplary embodiment of the present general inventive concept will be described with reference to FIGS. 1 to 3.

When the nozzle unit 200 is positioned in the printing section Sp, the nozzle unit 200 moves across a traveling direction of the printing medium P and prints an image onto the printing medium P using the printing ink 10. At this time, the switch valve 530 closes the auxiliary supply path 520 and opens the upstream of the main supply path 510, and thus, the printing ink 10 in the printing ink tank 100 flows to the nozzle part 210 to then be ejected onto the printing medium P.

When the nozzle unit 200 is positioned in the cleaning section Sc, the nozzle part 210 comes to face the collecting cup 610. At the same time, the cleaning ink supply outlet 420 is connected to the path connector 521 and the switch valve 530 closes the upstream of the main supply path 510 and opens the auxiliary supply path 520. Accordingly, a circulation path of the cleaning ink 20 is formed between the cleaning ink tank 400, the cleaning ink supply path 410, the auxiliary supply path 520, the downstream of the main supply path 510, the nozzle part 210, the collecting cup 610, and the collecting path 620.

Then, the pump 700 is operated, and thus, the cleaning ink 20 is supplied to the nozzle part 210 from the cleaning ink tank 400 to clean the nozzle part 210.

The cleaning ink 20, which has been discharged from the nozzle part 210, is collected into the collecting cup 610 and then returns to the cleaning ink tank 400 through the collecting path 620. The returned cleaning ink 20 may be repeatedly reused for the cleaning process.

After cleaning the nozzle part 210, the pump 700 stops operation, and thus, the circulation of the cleaning ink 20 also stops.

Then, the nozzle unit 200 moves into the printing section Sp, and the path connector 521 is separated from the cleaning ink supply outlet 420. Accordingly, the switch valve 530 closes the auxiliary supply path 520 and opens the upstream of the main supply path 510. Thus, the printing ink 10 is supplied from the printing ink tank 100 to the nozzle part 210 through the main supply path 510, and then, is ejected onto the printing medium P to form an image.

At this time, a small amount of the cleaning ink 20 may remain in the main supply path 510 and mix with the printing ink 10. However, because the colors of the printing ink 10 and the cleaning ink 20 are the same, image quality deterioration due to the mixture of the printing ink 10 and the cleaning ink 20 can be prevented.

As described above, a cleaning process for a nozzle part 210 of an image forming apparatus can be performed by a cleaning ink 20 other than a printing ink 10 to thereby prevent the printing ink 10, which is relatively expensive, from being used for the cleaning process. Further, the cleaning ink which has been used for the cleaning process can be collected and repeatedly reused for a subsequent cleaning process.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a printing ink tank to contain a printing ink;

a nozzle unit having a nozzle part to eject the printing ink and to move between a printing section and a cleaning section;

a cleaning ink tank to contain a cleaning ink to clean the nozzle part;

a cleaning ink tube to supply cleaning ink from the cleaning ink tank to the nozzle unit; and a control part to control supply of the printing ink to the nozzle part when the nozzle unit is positioned in the printing section and to control supply of the cleaning ink to the nozzle part when the nozzle unit is positioned in the cleaning section, wherein the cleaning ink tube physically separates from the nozzle unit when the nozzle unit is in the printing ink section.

2. The image forming apparatus according to claim 1, wherein the printing section is a section in which the nozzle unit forms an image on a printing medium and the cleaning section is a section in which the nozzle unit moves out of the printing position and the nozzle part is cleaned.

3. The image forming apparatus according to claim 1, wherein the printing section is a printing time when the nozzle unit forms an image on a printing medium and the cleaning section is a cleaning time when the nozzle part is cleaned.

4. The image forming apparatus according to claim 1, wherein the printing ink tank is installed on the nozzle unit to supply the printing ink to the nozzle part.

5. The image forming apparatus according to claim 1, further comprising:

a main supply path in the nozzle unit to connect the printing ink tank and the nozzle part.

6. The image forming apparatus according to claim 5, further comprising:

an auxiliary supply path that extends from the main supply path to connect to the cleaning ink supply outlet when the nozzle unit is positioned in the cleaning section.

7. The image forming apparatus according to claim 6, further comprising:

a switch valve provided at a point where the main auxiliary supply path connects to the main supply path to selectively block supply of the printing ink and selectively allow supply of the cleaning ink according to the position of the nozzle unit.

8. The image forming apparatus according to claim 1, further comprising:

a cleaning ink collecting unit which collects the cleaning ink discharged from the nozzle part and returns the collected cleaning ink to the cleaning ink tank.

9. The image forming apparatus according to claim 8, wherein the cleaning ink collecting part comprises:

a collecting cup which collects the cleaning ink discharged from the nozzle part; and a collecting path which returns the cleaning ink collected in the collecting cup to the cleaning ink tank.

10. The image forming apparatus according to claim 6, wherein the switch valve blocks supply of the printing ink and allows supply of the cleaning ink when the nozzle unit is in the cleaning section, and the switch valve allows supply of the printing ink when the nozzle unit is in the printing section.

11. An image forming apparatus, comprising:

a nozzle unit to form an image on a printing medium;

a printing ink unit to store a printing ink and to supply the printing ink to the nozzle unit;

a cleaning unit to store a cleaning ink and to supply the cleaning ink to the nozzle unit; and an ink selection unit, to selectively supply one of the printing ink and the cleaning ink to the nozzle unit, wherein the cleaning unit includes a cleaning ink supply tube to supply cleaning ink from the cleaning unit to the nozzle unit, and the cleaning ink supply tube physically separates from the nozzle unit when the nozzle unit forms an image on a printing medium.

12. The image forming apparatus according to claim 11, wherein:

the nozzle unit is positionable at one of a printing position to form the image on the printing medium and a cleaning position to clean the nozzle unit, and the ink selection unit supplies the printing ink to the nozzle unit when the nozzle unit is at the printing position and supplies the cleaning ink to the nozzle unit when the nozzle unit is in the cleaning position.

13. The image forming apparatus according to claim 12, further comprising:

a nozzle unit supporter to support the nozzle unit and to allow the nozzle unit to move between the printing position and the cleaning position.

14. The image forming apparatus according to claim 11, wherein the cleaning ink is not supplied to the nozzle unit during a printing operation.

15. The image forming apparatus according to claim 11, wherein the printing ink is not supplied to the nozzle unit during a cleaning operation.

16. An image forming apparatus, comprising:

a movable nozzle unit to move between a printing position to form an image on a printing medium and a cleaning position to clean the nozzle unit;

a printing ink tank to supply a printing ink to the nozzle unit when the nozzle unit is at the printing position;

a cleaning ink tank to supply a cleaning ink to the nozzle unit when the nozzle unit is at the cleaning position;

a cleaning ink supply tube to supply cleaning ink from the cleaning ink tank to the printing ink tank; and a controller to control supply of the printing ink and the cleaning ink to the nozzle unit according to a position of the nozzle unit, wherein the cleaning ink supply tube physically separates from the movable nozzle when the movable nozzle is in the printing position.

17. The image forming apparatus of claim 16, wherein the controller prevents the printing ink from being supplied to the nozzle unit during a cleaning operation, and prevents the cleaning ink from being supplied to the nozzle unit during a printing operation.

18. A method of cleaning a nozzle unit of an image forming apparatus, the method comprising:

positioning the nozzle unit at a cleaning position;

supplying a cleaning ink to the nozzle unit;

ejecting the cleaning ink through the nozzle unit to clean the nozzle unit; and returning the nozzle unit to a printing position from the cleaning position, wherein the cleaning ink is supplied separately from a printing ink used to form an image on a printing medium, the cleaning ink ejected from through the nozzle is supplied again to the nozzle unit to be ejected through the nozzle, and returning of the nozzle unit to the printing position includes physically disconnecting the clean in ink supply path from the nozzle unit.

19. The method according to claim 18, wherein the cleaning ink is not supplied to form an image on the printing medium.

20. The method according to claim 18, wherein the supplying of the cleaning ink to the nozzle unit comprises:

connecting a cleaning ink supply path to the nozzle unit, supplying the cleaning ink to the nozzle unit, and preventing the printing ink from being supplied to the nozzle unit.

21. The method according to claim 18, wherein the cleaning position is a position different from a printing position at which the nozzle unit performs a printing operation to form an image on the printing medium.

22. The method according to claim 18, wherein the returning of the nozzle unit to the printing position comprises:

positioning the nozzle unit at the printing position, supplying the printing ink to the nozzle unit, and preventing the cleaning ink from being supplied to the nozzle unit.

* * * * *